US009161638B2

(12) United States Patent
Ehmke et al.

(10) Patent No.: US 9,161,638 B2
(45) Date of Patent: Oct. 20, 2015

(54) RETAIL MERCHANDISING PLATFORM

(71) Applicant: Schlage Lock Company LLC, Indianapolis, IN (US)

(72) Inventors: Paul Michael Ehmke, Houston, TX (US); Christopher Michael Nusbaum, Avon, IN (US); Lori Ann Long, Speedway, IN (US); John DeVito, Des Plaines, IL (US)

(73) Assignee: Schlage Lock Company LLC, Indianapolis, IN (US)

( * ) Notice: Subject to any disclaimer, the term of this patent is extended or adjusted under 35 U.S.C. 154(b) by 142 days.

(21) Appl. No.: 13/653,875

(22) Filed: Oct. 17, 2012

(65) Prior Publication Data

US 2013/0093298 A1 Apr. 18, 2013

Related U.S. Application Data

(60) Provisional application No. 61/548,109, filed on Oct. 17, 2011.

(51) Int. Cl.

| | |
|---|---|
| ***A47F 3/00*** | (2006.01) |
| ***A47F 5/00*** | (2006.01) |
| ***A47F 7/00*** | (2006.01) |
| ***A47B 45/00*** | (2006.01) |
| ***A47B 53/00*** | (2006.01) |
| *A47F 5/10* | (2006.01) |

(52) U.S. Cl.

CPC . *A47F 3/00* (2013.01); *A47B 45/00* (2013.01); *A47B 53/00* (2013.01); *A47F 5/0087* (2013.01); *A47F 5/0093* (2013.01); *A47F 7/00* (2013.01); *A47F 5/101* (2013.01)

(58) Field of Classification Search

CPC ..... A47F 3/00; A47F 7/00; A47F 5/0093; A47F 5/008; A47F 5/101; A47F 5/0087; A47B 53/00; A47B 45/00

USPC ..... 312/334.24, 334.28, 122, 132, 139.2, 312/234; 211/191, 182, 162, 175; 49/409, 49/410, 411, 425, 158, 159, 160, 176, 177, 49/178, 179, 180, 181; 700/236, 237, 242

See application file for complete search history.

(56) References Cited

U.S. PATENT DOCUMENTS 1,862,757 A * 6/1932 Menns ..... 49/181
2,122,182 A * 6/1938 Rogers ..... 49/175

(Continued)

*Primary Examiner* — Daniel J Troy
*Assistant Examiner* — Hiwot Tefera
(74) *Attorney, Agent, or Firm* — Taft Stettinius & Hollister LLP

(57) ABSTRACT

Door lock merchandising display apparatus, systems and methods are disclosed. An exemplary apparatus includes a support structure including first and second fixtures positioned in a merchandise display region. The fixtures are laterally and rotatably movable relative to the support structure. The apparatus includes merchandise modules that include door locks and are detachably coupled with respective fixtures. Interior and exterior portions of the door locks are displayed on respective sides of the modules. A customer can position the fixtures to selectably simultaneously display the interior and exterior portions of the door locks. The apparatus may also include a customer-accessible inventory storage region and a customer interaction unit configured to receive customer input associated with a particular type of door lock and provide an output to the customer identifying a location of the particular type of door lock in the inventory storage region.

21 Claims, 17 Drawing Sheets

(56) References Cited

U.S. PATENT DOCUMENTS

| | | | | | |
|---|---|---|---|---|---|
| 2,948,403 | A | | 8/1960 | Vallez | |
| 2,983,055 | A | | 5/1961 | Falk et al. | |
| 3,200,958 | A | * | 8/1965 | Hudgeons, Sr. et al. | 211/4 |
| 3,345,026 | A | | 10/1967 | Schlage | |
| 3,978,799 | A | * | 9/1976 | Escalette | 108/28 |
| 4,475,311 | A | * | 10/1984 | Gibson | 49/176 |
| 4,644,691 | A | * | 2/1987 | Wright | 49/161 |
| 4,914,861 | A | * | 4/1990 | May | 49/181 |
| 5,057,977 | A | * | 10/1991 | Kurzman | 362/125 |
| 5,090,171 | A | * | 2/1992 | Kano et al. | 52/243.1 |
| 5,139,155 | A | * | 8/1992 | Laxson | 211/169 |
| 5,299,121 | A | * | 3/1994 | Brill et al. | 600/301 |
| D356,827 | S | | 3/1995 | Shafley | |
| 5,405,193 | A | * | 4/1995 | Herrenbruck | 312/118 |
| 5,415,296 | A | * | 5/1995 | Wright | 211/40 |
| 5,636,475 | A | * | 6/1997 | Nidelkoff | 49/178 |
| 5,927,544 | A | * | 7/1999 | Kanoh et al. | 221/90 |
| 6,102,502 | A | * | 8/2000 | Melillo et al. | 312/234 |
| 6,276,092 | B1 | * | 8/2001 | Neo | 49/183 |
| 6,497,329 | B1 | * | 12/2002 | Johnson et al. | 211/128.1 |
| 6,751,904 | B2 | * | 6/2004 | Prete et al. | 49/181 |
| 7,296,608 | B2 | * | 11/2007 | Weishar et al. | 160/200 |
| 8,186,189 | B2 | * | 5/2012 | Brisco et al. | 70/100 |
| 8,392,018 | B2 | * | 3/2013 | Wang et al. | 700/236 |
| 8,627,604 | B2 | * | 1/2014 | Seymour et al. | 49/141 |
| 8,806,807 | B2 | * | 8/2014 | Rees | 49/257 |
| 8,833,572 | B1 | * | 9/2014 | Billman | 211/94.01 |
| 8,967,738 | B2 | * | 3/2015 | Blase | 312/111 |
| 2002/0143696 | A1 | * | 10/2002 | Wilson et al. | 705/38 |
| 2004/0039592 | A1 | * | 2/2004 | Shima | 705/1 |
| 2007/0034694 | A1 | * | 2/2007 | Jensen et al. | 235/439 |
| 2007/0169899 | A1 | * | 7/2007 | Cianciolo et al. | 160/211 |
| 2008/0099418 | A1 | * | 5/2008 | Wells | 211/85.26 |
| 2009/0076650 | A1 | * | 3/2009 | Faes | 700/232 |
| 2009/0078664 | A1 | * | 3/2009 | Steffan | 211/153 |
| 2009/0115299 | A1 | * | 5/2009 | Ricereto | 312/330.1 |
| 2009/0241611 | A1 | * | 10/2009 | Brisco et al. | 70/95 |
| 2010/0030371 | A1 | * | 2/2010 | Chudy et al. | 700/215 |
| 2011/0094161 | A1 | * | 4/2011 | Rees | 49/260 |
| 2011/0240576 | A1 | * | 10/2011 | Abbruzzese et al. | 211/85.3 |
| 2011/0240822 | A1 | * | 10/2011 | Costa | 248/480 |
| 2011/0297630 | A1 | * | 12/2011 | O'Day et al. | 211/59.2 |
| 2012/0073205 | A1 | * | 3/2012 | Hamaker et al. | 49/163 |
| 2012/0159851 | A1 | * | 6/2012 | Seymour et al. | 49/177 |
| 2012/0255230 | A1 | * | 10/2012 | Smith et al. | 49/257 |
| 2014/0137449 | A1 | * | 5/2014 | English | 40/599 |

* cited by examiner

RETAIL MERCHANDISING PLATFORM

RELATED APPLICATION DATA

This application claims the benefit of U.S. Application No. 61/548,109 filed Oct. 17, 2011 and the same is hereby incorporated by reference.

BACKGROUND

The present application relates generally to retail sales displays and to interactive product displays and more particularly but not exclusively to displays for door locks. Product display of door locks presents a number of unique challenges. To be functional door locks must be installed in a door or a display structure or stand which simulates their installed state. Conventional merchandising displays include door locks installed in doors or in other display structures or stands which limit or impair comparisons of various locks by fixing them in place. Alternatives such as loose or unfixed displays which might permit comparison do not allow lock function to be meaningfully evaluated. Customers could benefit from the ability to evaluate and compare the aesthetic features of different door locks as well as their functionality, feel and tactile response. Customers also face the challenge of locating particular door locks in displays that may include a large number of different locks and determining the location of the saleable inventory of a desired lock. Conventional approaches to door lock product display have left these and other needs unfulfilled.

SUMMARY

For the purposes of clearly, concisely and exactly describing exemplary embodiments of the invention, the manner and process of making and using the same, and to enable the practice, making and use of the same, certain aspects of the disclosure will now be summarized and exemplary embodiments illustrated in the figures will be described in detail below. It shall be understood that no limitation of the scope of the invention is thereby created and that the invention includes and protects such alterations, modifications, and further applications as would occur to one skilled in the art.

Certain exemplary embodiments include door lock merchandising display apparatuses. One exemplary apparatus includes a support structure including a merchandise display region. A first fixture is coupled with the support structure and positioned in the merchandise display region. The first fixture is laterally and rotatably movable relative to the support structure. The apparatus includes a first merchandise module including a first door lock. The first merchandise module is detachably coupled with the first fixture. An interior portion of the first door lock is displayed from a first side of the first merchandise module, and an exterior portion of the first door lock is displayed from a second side of the first merchandise module. The apparatus further includes a second fixture coupled with the support structure and positioned in the merchandise display region. The second fixture is laterally and rotatably movable relative to the support structure. The apparatus includes a second merchandise module including a second door lock. The second merchandise module is detachably coupled with the second fixture. An interior portion of the second door lock is displayed from a first side of the second merchandise module, and an exterior portion of the second door lock is displayed from a second side of the second merchandise module. The first fixture and the second fixture are positionable by a customer to selectably simultaneously display to the customer the interior portion of the first door lock and the interior portion of the second door lock and to selectably simultaneously display to the customer the exterior portion of the first door lock and the exterior portion of the second door lock.

Certain exemplary embodiments include door lock merchandising display systems. One exemplary system includes a merchandising platform including a display region, a customer-accessible inventory storage region, and a customer interaction unit. A plurality of merchandise display fixtures, each including one or more door locks, are positioned in the display region. Each of the door locks includes an interior portion and an exterior portion. The merchandise display fixtures are movable by the customer to a first configuration displaying the interior portions of at least two locks next to one another and movable by the customer to a second configuration displaying the exterior portions of the at least two locks next to one another. The customer-accessible inventory storage region includes: a plurality of types of door locks including the types of door locks of the merchandise display fixtures. The customer interaction unit is configured to receive customer input associated with a particular type of door lock of the door locks of the merchandise display fixtures and provide an output to the customer identifying a location of the particular type of door lock in the customer-accessible inventory storage region.

Certain exemplary embodiments include methods of displaying door lock merchandise. One exemplary method includes providing a merchandising platform including a customer-accessible inventory storage region, a customer interaction unit, and a merchandise display region including a plurality of fixtures, each including one or more door locks including first portions on respective first sides of the fixtures and second portions on respective second sides of the fixtures. The merchandise display fixtures are movable by a customer to display a first side of at least two fixtures next to one another and are movable by the customer to display a second side of the at least two fixtures next to one another. The method further includes storing in a plurality of locations in the customer-accessible inventory storage region a plurality of types of door locks including the types of door locks of the merchandise display fixtures. The method also includes receiving at the customer interaction unit an input indicating a particular type of door lock of the door locks of the merchandise display fixtures, and providing an output at the customer interaction unit identifying a location of the particular type of door lock in the customer-accessible inventory storage region.

DETAILED DESCRIPTION OF EXEMPLARY EMBODIMENTS

Figure 1:
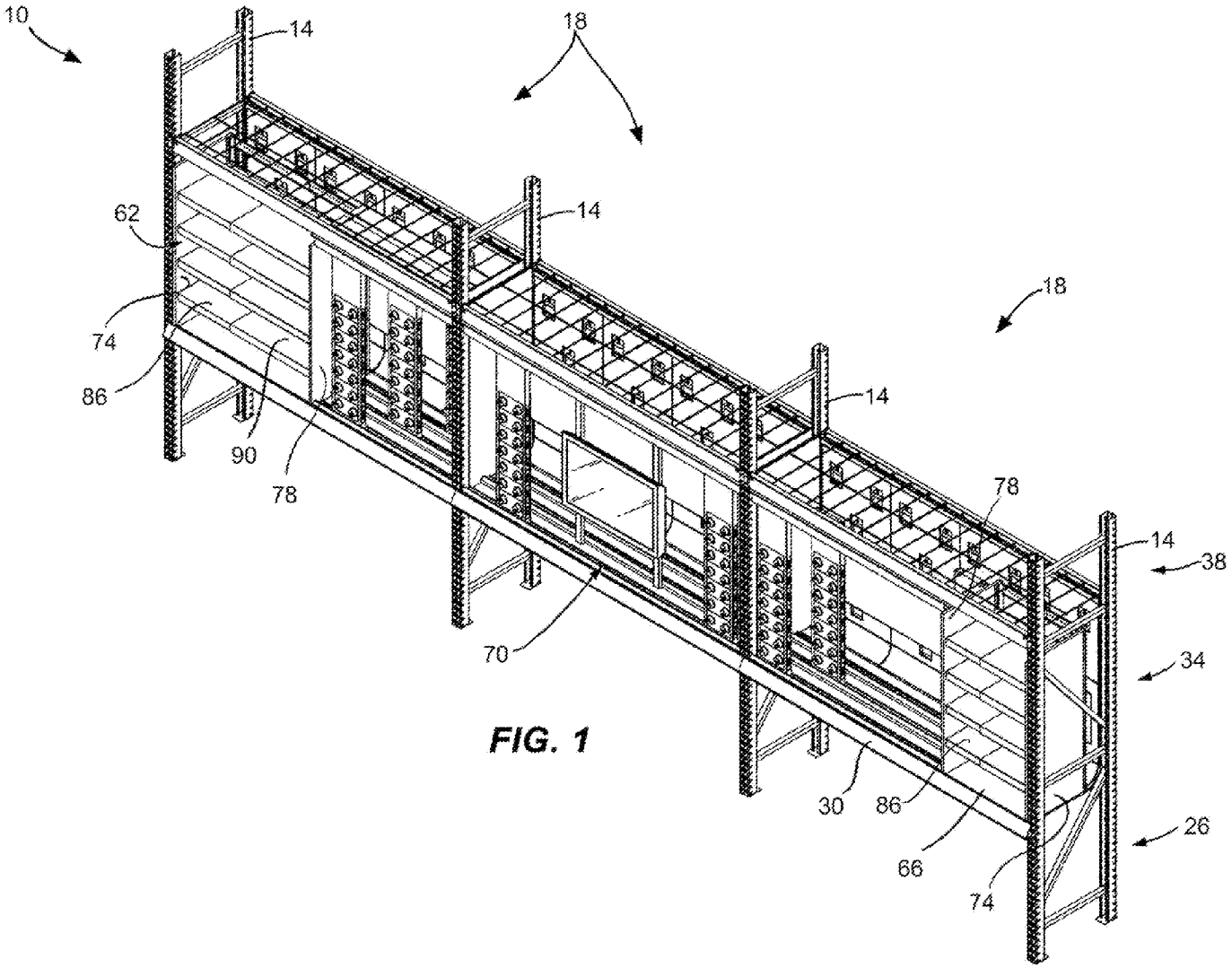
FIG. 1 is a perspective view of a retail merchandizing platform.

With reference to FIG. 1 there is illustrated a retail merchandizing platform 10 for displaying a class of products, for example, door locks. While many of the features described below are applicable to products other than door locks, the platform 10 is described primarily with respect to its application to door locks. As used herein, the term "door locks" refers to any type of door lock hardware, including door handles, door handlesets, door knobs, door levers, deadbolts, keyed locks, electronic deadbolts, electronic locks, combination key and electronic deadbolts or locks, and various other door locks for residential and commercial use. Also, in an exemplary form the platform 10 as described herein could be located in a retail home improvement store or a building supply store, and is adapted to fit into a standard-sized display rack area. For example, in the illustrated embodiment, the platform 10 is mounted onto frame members 14 that partition the platform 10 into three vertical sections, or bays 18, that are eight feet wide. The platform 10 may have bays 18 that are wider or narrower and the platform 10 may be used with frame members having a different size or spacing. In other embodiments, the merchandizing platform 10 may include fewer or more bays 18. In addition, the merchandizing platform 10 may be adjusted in depth by extending the length of a frame support 20 as illustrated, for example in connection with FIG. 3.

Figure 2:
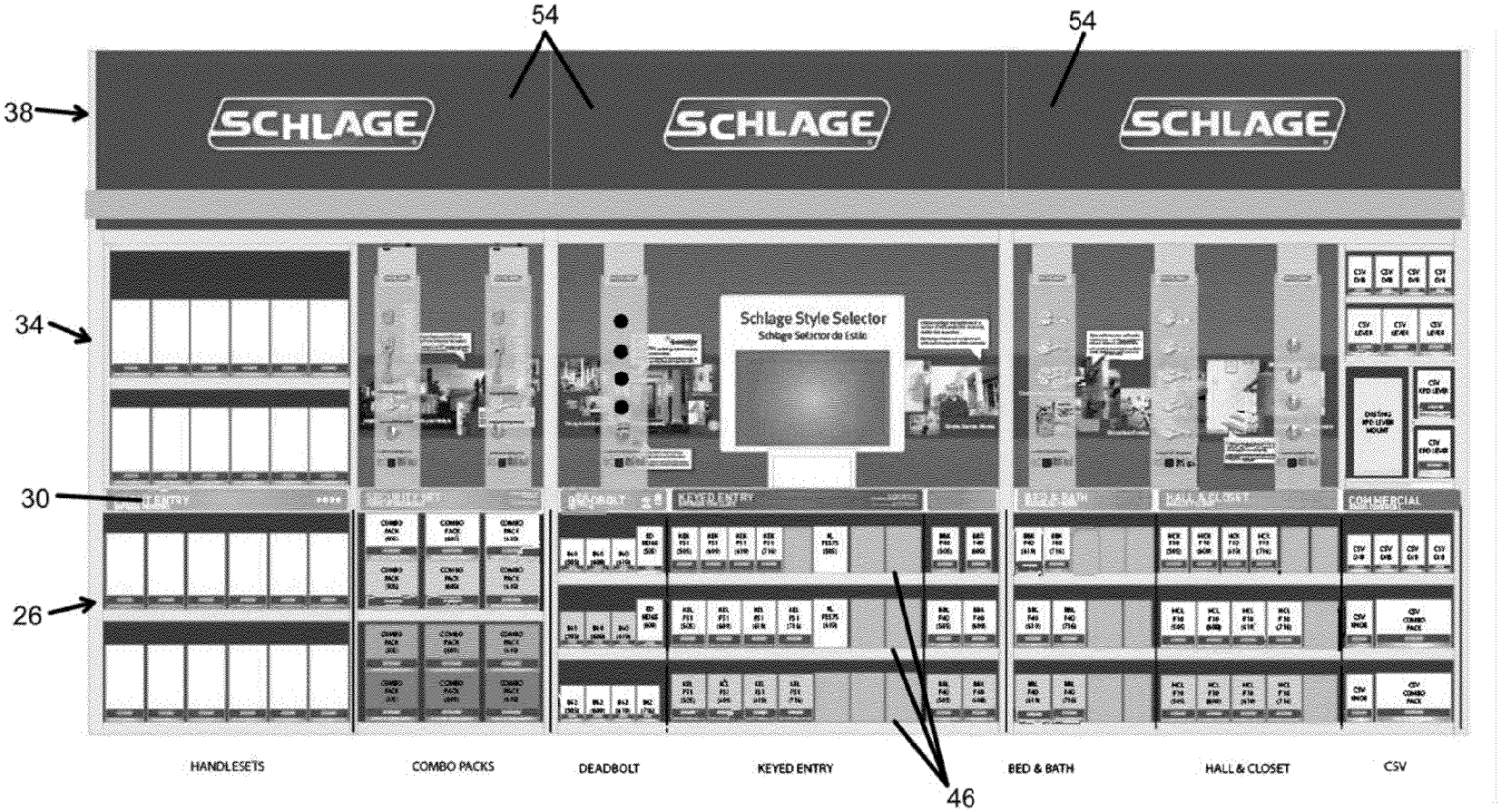
FIG. 2 is a front view of an additional retail merchandizing platform.
Figure 4:
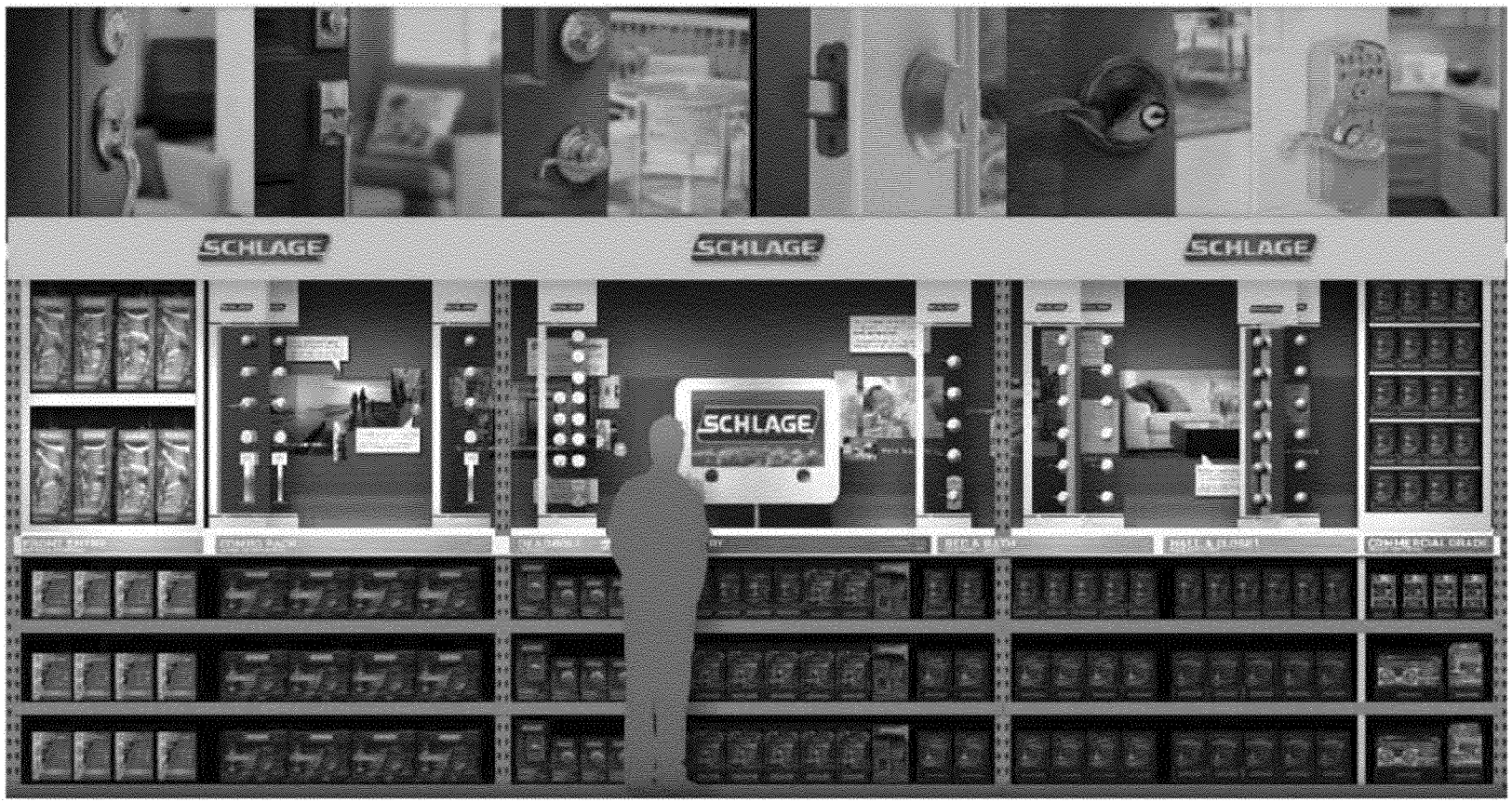
FIG. 4 is a front view of an additional retail merchandizing platform.
Figure 5:
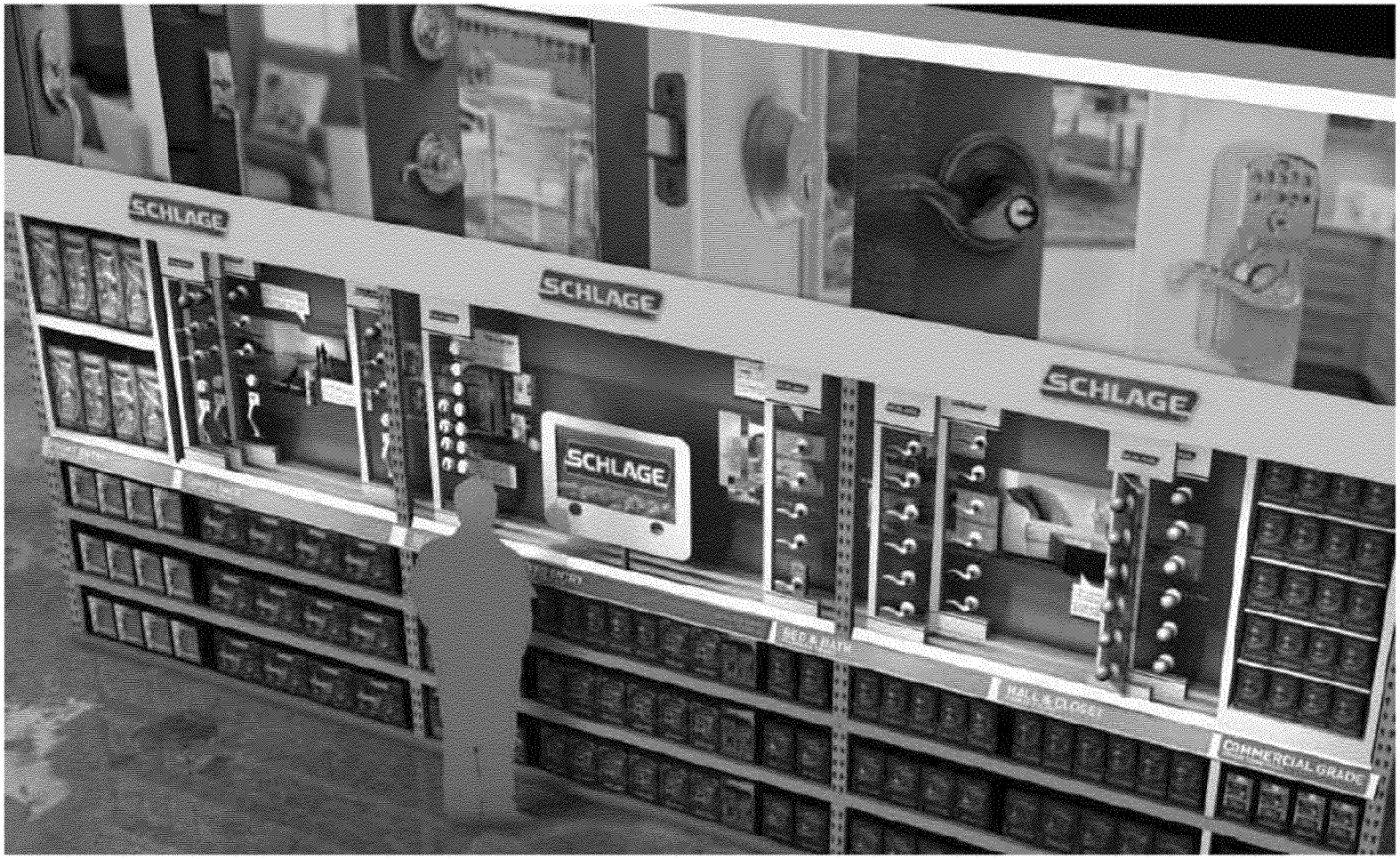
FIG. 5 is a perspective view of the retail merchandizing platform shown in FIG. 4.

In the embodiment illustrated in FIG. 2, the merchandizing platform 10 defines a first or lower level 26, a wayfinding bar 30, a second or middle level 34, and a third or upper level 38. The lower level 26 is located proximate a support surface or floor and includes multiple inventory shelves 46 which are configured to be accessible by customers. The wayfinding bar 30 is located above the inventory shelves 46 and indicates the category of lock that is housed in various sections of the inventory shelves 46. The wayfinding bar 30 may include labels for many categories of locks, such as handleset, front entry, security, deadbolt, keyed entry, bed & bath, hall & closet, and commercial. The available models for each type of lock are positioned immediately below or immediately above the appropriate section of the wayfinding bar 30. FIGS. 4 and 5 illustrate an alternative embodiment of the merchandizing platform 10. In other embodiments, the retail merchandizing platform may not be arranged in three levels, but may be arranged such that the various portions of the platform overlap in height.

With further reference to FIG. 2, the upper level 38 defines multiple storage areas 54 for storing additional product inventory. Each storage area 54 includes doors (not shown) for concealing the inventory. In one embodiment, the doors are arranged in pairs, and the doors slide with respect to one another. The inventory is hidden behind the doors, but can be accessed for restocking. Typically, the doors are covered with graphics or images. In other embodiments, the merchandizing platform 10 may omit the storage areas 54.

Figure 7:
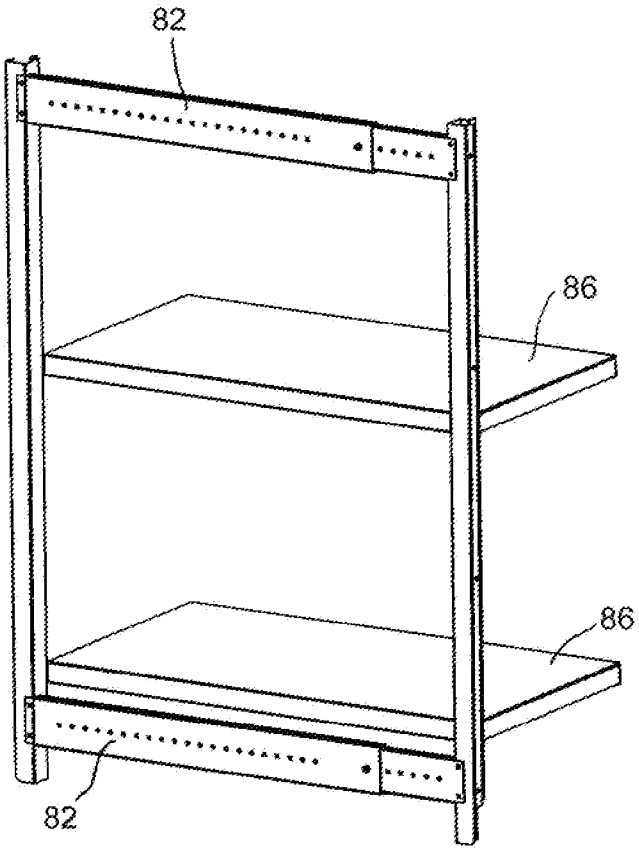
FIG. 7 is a rear perspective view of the adjustable shelf portion of FIG. 6.
Figure 6:
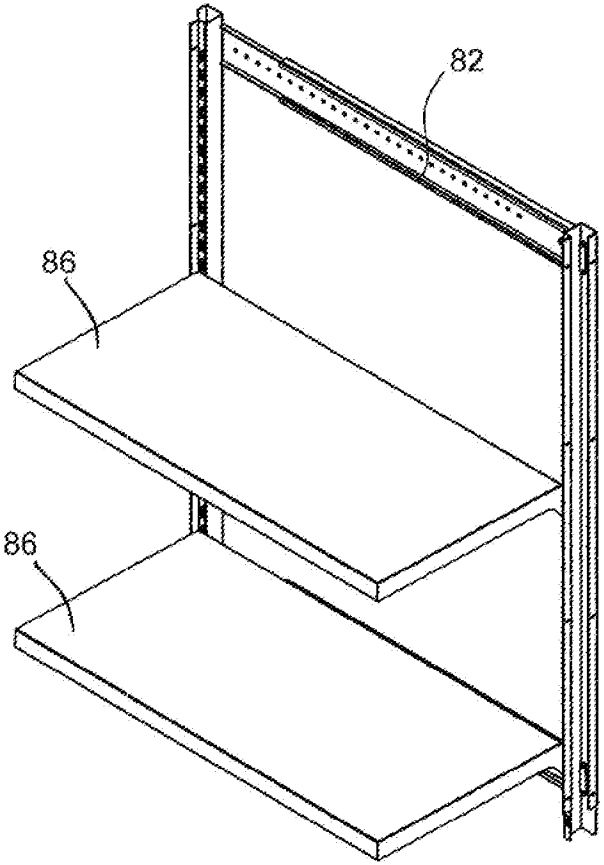
FIG. 6 is a perspective view of an adjustable shelf portion in a retracted state.
Figure 8:
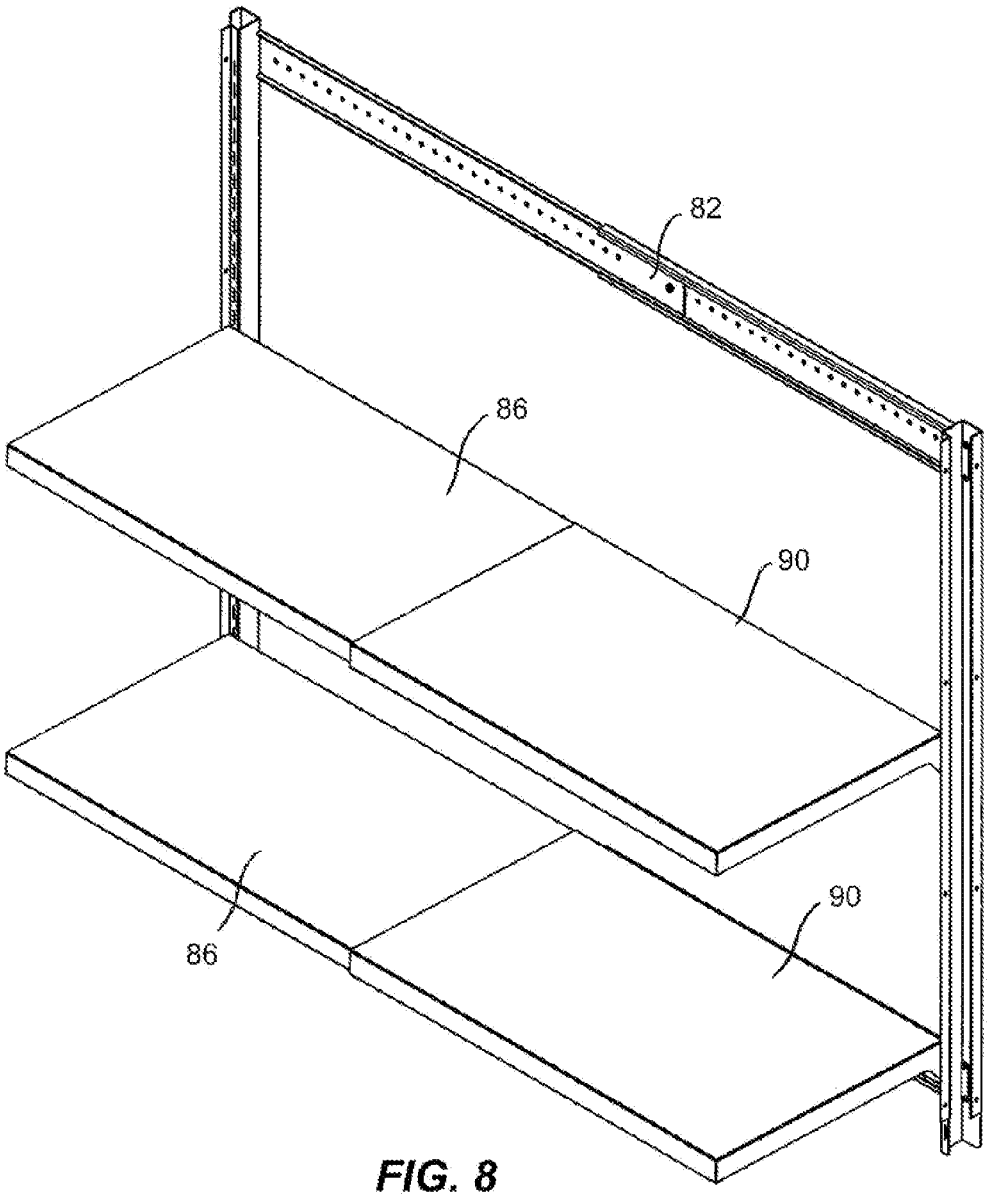
FIG. 8 is a perspective view of the adjustable shelf portion of FIG. 6 in an extended state.

Referring now to FIG. 1, the middle level 34 includes a first adjustable shelf portion 62, a second adjustable shelf portion 66, and an interactive merchandise display portion 70. The adjustable shelf portions may be utilized to store merchandise inventory accessible to customers. The first adjustable shelf portion 62 includes a first wall 74, a second wall 78 opposite the wall 74, a shelf bracket 82 (FIGS. 6-8), and at least one shelf 86 supported between the wall 74 and the wall 78. Referring to FIGS. 6-8, the shelf bracket 82 couples the wall 74 and the wall 78. The shelf bracket 82 is telescoping, or extendible, such that the bracket 82 can be extended to move the wall 78 away from the wall 74. In the illustrated embodiment, when the support bracket 82 is extended, a second shelf 90 is supported between the shelf 86 and the second wall 78 (FIG. 1). In other embodiments, the shelf 86 may be removed and replaced with a wider shelf (not shown). The second adjustable portion 66 includes the components similar to the first adjustable portion 62, such as the first wall 74, the second wall 78, a shelf bracket 82, and at least one shelf 86 supported between the first wall 74 and the second wall 78. In other embodiments, the middle level 34 includes fewer or more adjustable shelf portions.

Figure 3:
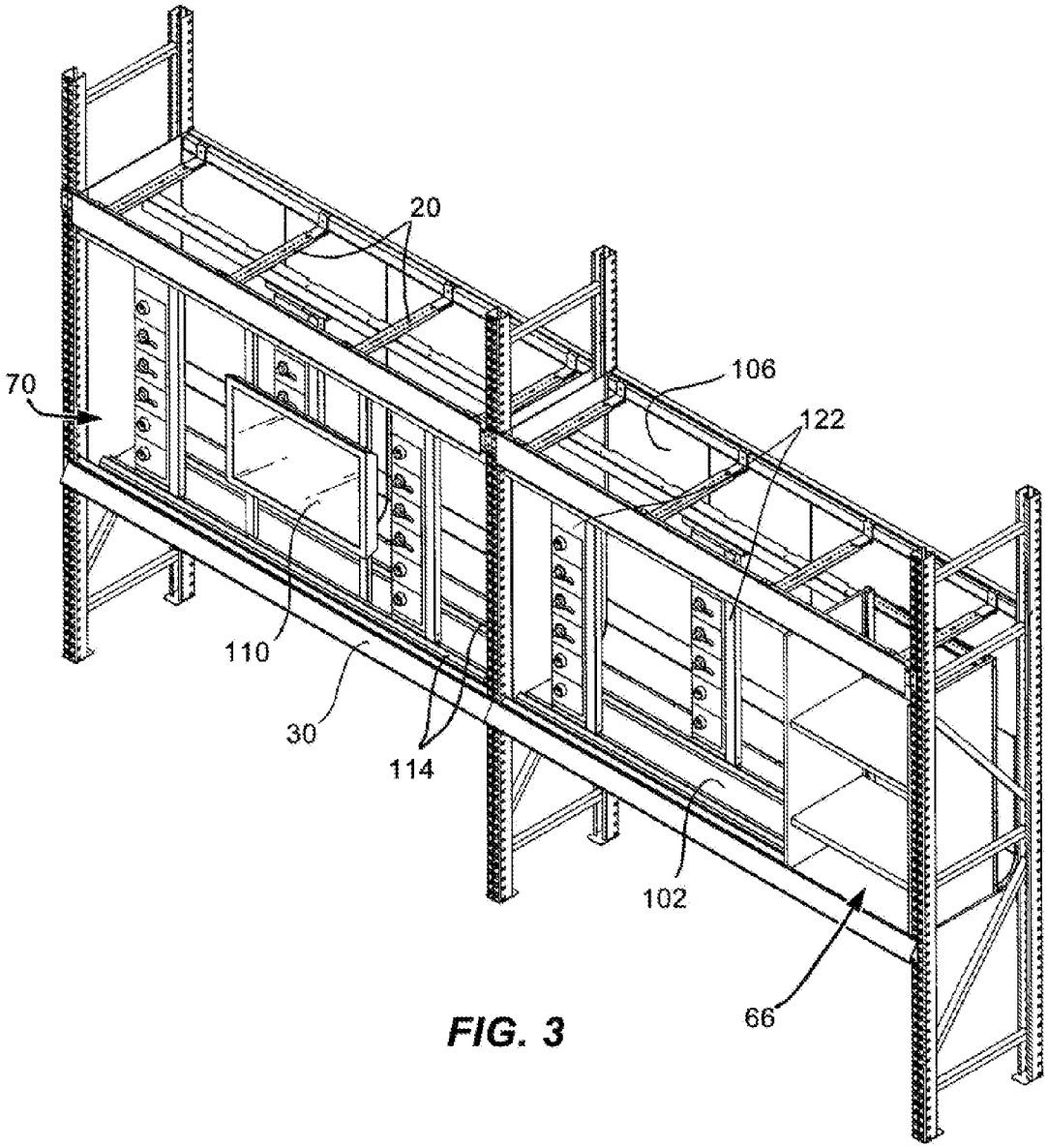
FIG. 3 is a perspective view of a portion of the merchandizing platform of FIG. 1.

The interactive merchandise display portion 70 extends across the bays 18 and is divided into three sections by the frame members 14. In other embodiments, the interactive merchandise display portion 70 may include fewer or more sections. As shown in FIG. 3, the interactive merchandise display portion 70 includes a customer interaction unit 110, a deck 102, a back wall 106, multiple tracks 114, and multiple fixtures 122 movably engaging tracks 114.

With reference to FIG. 3, the customer interaction unit 110 aids a customer in searching various lock options and/or locating a particular lock to purchase. In the illustrated embodiment, the customer interaction unit 110 includes a liquid-crystal display (LCD) touch screen at an integrated microprocessor-based control unit such as a computer. The customer may input a type of door lock of interest to the controller using the LCD touch screen. In further embodiments, additional customer input devices may be associated with the different types of locks located in the interactive merchandise display portion 70. The additional customer input devices may be coupled with individual door lock display units, such as modules 206 illustrated in FIG. 12, that are connected to a display fixture. The additional customer input devices may also be coupled with a display fixture in regions proximate individual door lock display units. The additional customer input devices may communicate customer input to the customer interaction unit 110 through a wired or wireless communication link.

When the customer provides input indicating a particular lock of interest, the customer interaction unit 110 shows an image of the merchandizing platform 10 and indicates the exact location of the inventory of the appropriate lock. The wayfinding bar 30 provides a point of reference and allows the customer to quickly locate the shelf of the platform 10 on which the lock is located. The display 110 may also provide inventory information regarding the lock of interest, such as the number of locks remaining in inventory, an indication that additional locks should be ordered, and/or alternate locations where additional inventory is located.

Figure 9:
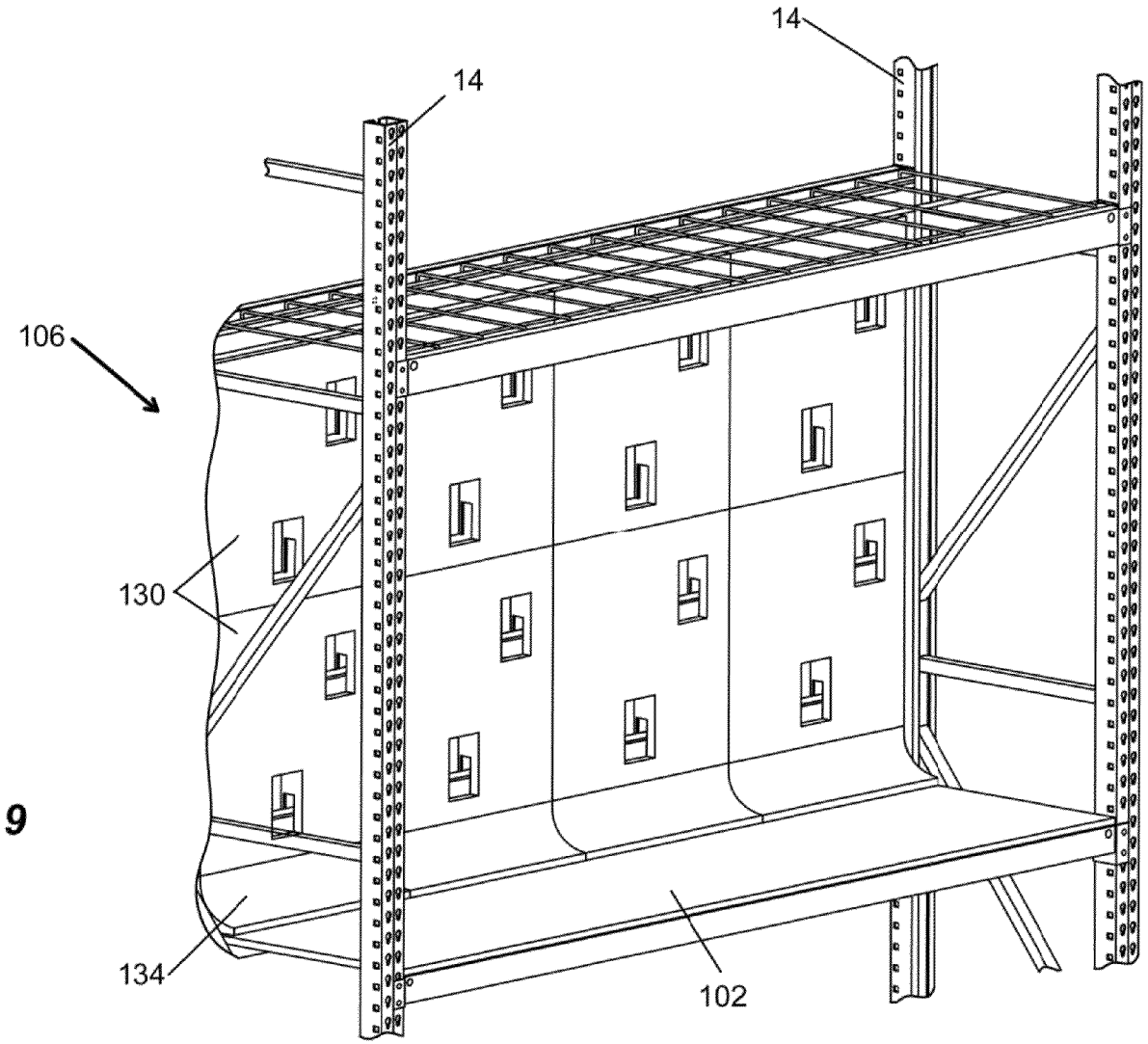
FIG. 9 is a perspective view of a back wall of an interactive merchandise display portion.
Figure 10:
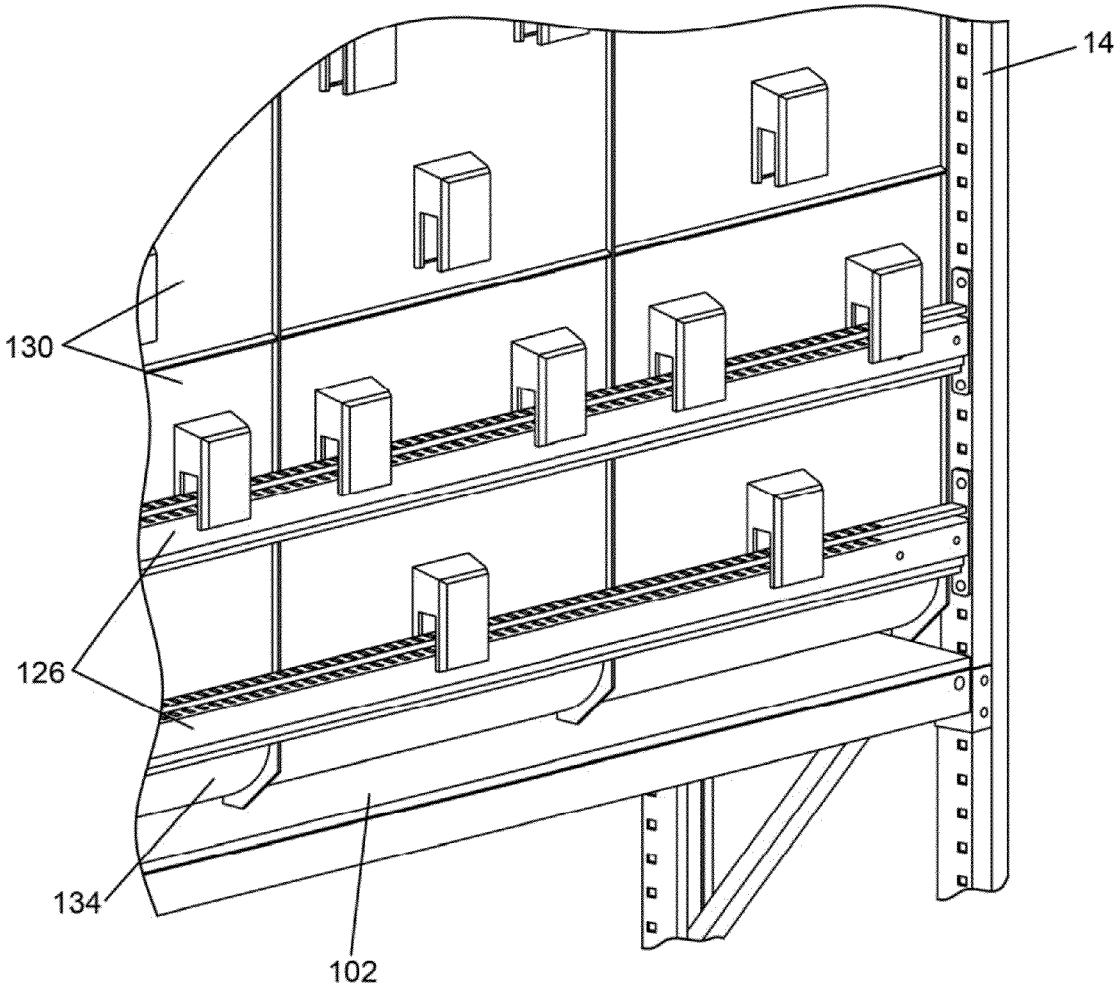
FIG. 10 is a rear perspective view of a back wall of the interactive merchandise display portion of FIG. 9.

As illustrated in FIGS. 9 and 10, the back wall 106 extends above the deck 102 and includes multiple crossbars 126 (FIG. 10) and multiple modular panels 130. The crossbars 126 (FIG. 10) are coupled to the frame members 14 by snapping onto the frame members 14 to avoid drilling into the frame members 14. In other embodiments, the crossbars 126 may be coupled to the frame members 14 in a number of ways. The modular panels 130 are preferably vacuum formed and are coupled to the crossbars 126. Modular panels 130 adjacent the deck 102 include a curved lower portion 134 that provides a smooth transition between the back wall 106 and the deck 102 to avoid a visual impediment that disrupts the viewer. Modular panels 130 positioned away from the deck 102 do not include a curved portion. The modular panels 130 may be covered with graphics or images.

With reference to FIGS. 11-19 there are illustrated more detailed views of fixtures 122 and modules 206 which may be provided in a merchandise display region such as those illustrated and described in connection with FIGS. 1-5. When installed in a merchandise display region of a merchandising platform, fixtures 122 and modules 206 coupled therewith may be positioned by a customer to selectably simultaneously display interior portions of two or more door locks, and exterior portions of two or more door locks. The fixtures 122 are laterally movable by a customer to allow fixtures on the same track or on different tracks to be moved side-by-side or spaced apart at a distance desired by the customer. The fixtures 122 are also rotatable to allow the customer to selectably simultaneously display either the interior or exterior portions of the door locks. The number of comparisons that may be made by a customer are a function of the number of fixtures and the number of tracks provided in a particular platform. The embodiments illustrated in FIGS. 1-5 are non-limiting examples of platforms permitting a customer-selectable display of interior and exterior portions of a plurality of door locks. Additional embodiments may include greater or fewer fixtures, greater or fewer tracks, and greater or fewer modules than the illustrated embodiments.

Figure 11:
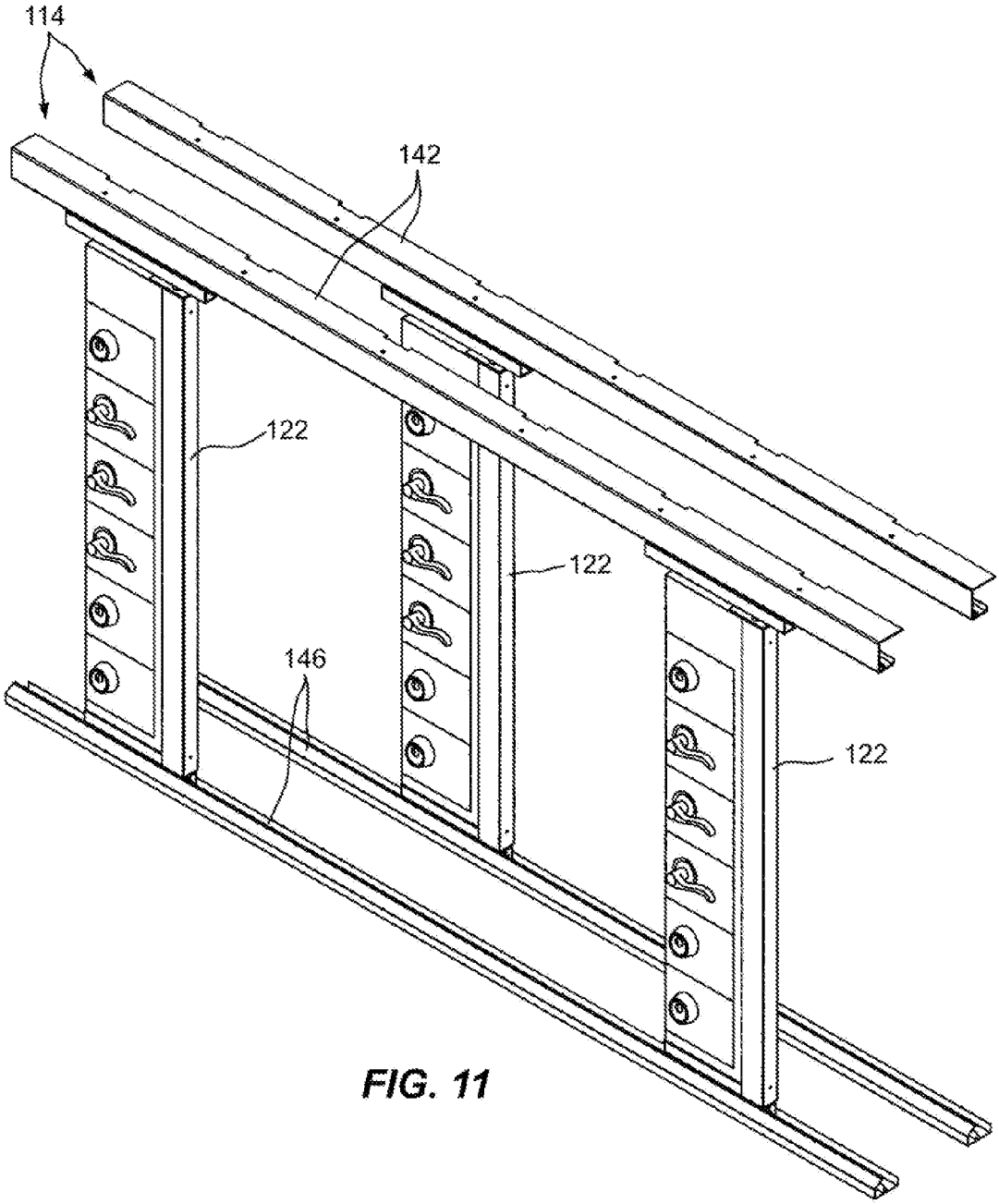
FIG. 11 is a perspective view of multiple fixtures and tracks.
Figure 12:
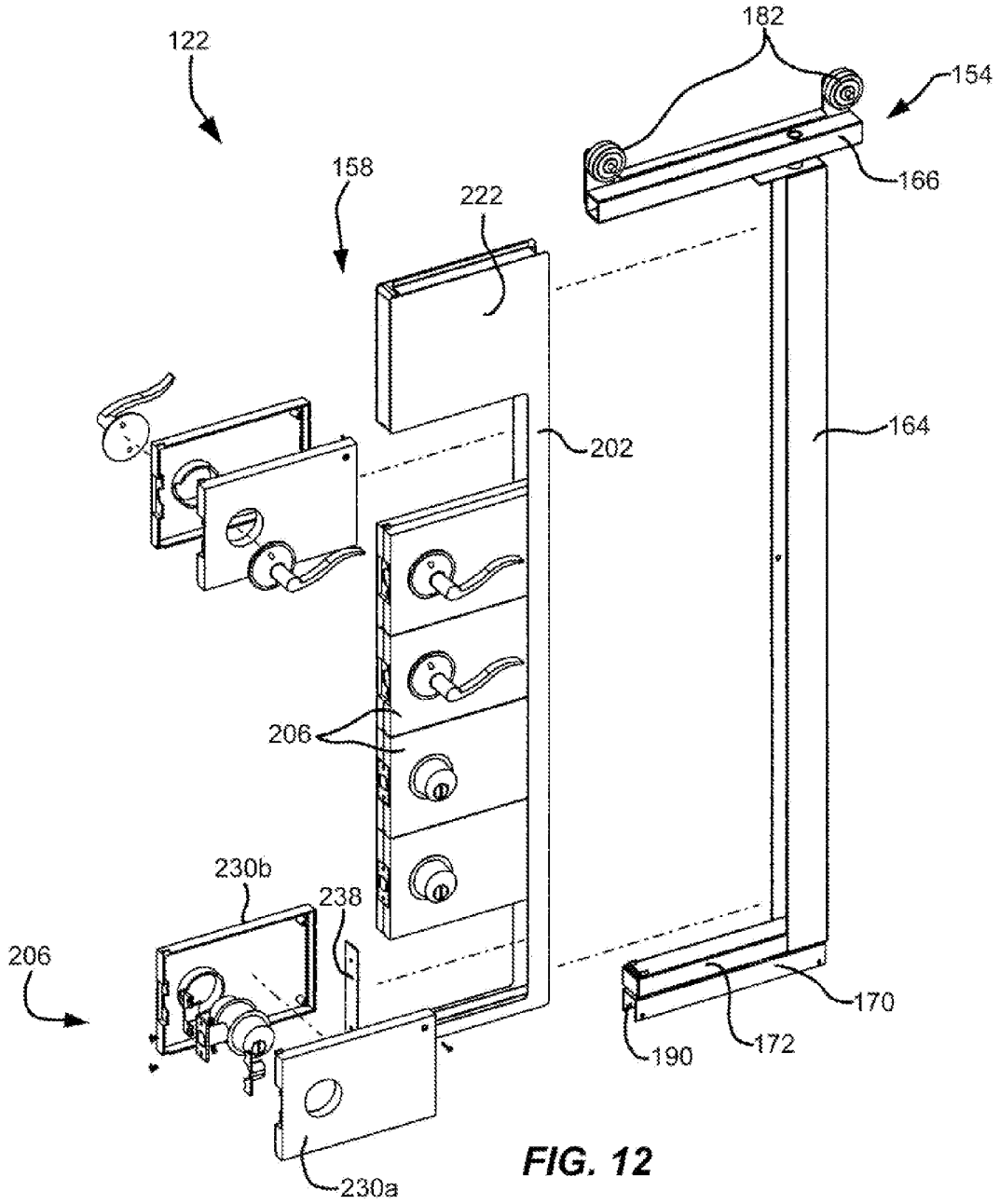
FIG. 12 is an exploded view of a fixture.

As illustrated in FIG. 11, each track 114 extends horizontally across the bay 18. Each track 114 includes a first or upper portion 142 and a second or lower portion 146 coupled to the deck 102. The upper portion 142 supports at least one fixture 122. As illustrated in FIG. 12, each fixture 122 includes a main frame 154 and a subframe 158. As further illustrated in FIGS. 12-13, the main frame 154 includes a rod 162, a sleeve 164 pivotable about the rod 162, a first or upper arm 166 coupled to the upper end of the rod 162, and a second or lower arm 170 coupled to the lower end of the rod 162. An arm 172 extends from the lower end of the sleeve 164 above the arm 170. The sleeve 164 and the arm 172 receive the subframe 158. In certain embodiments, the sleeve 164 can pivot with respect to the rod 162 through an angle of approximately 108°. In further embodiments, the sleeve 164 can pivot with respect to the rod 162 through different angles, for example approximately 90°, 180°, 360°, or other angular ranges. A wheel 174 mounted on the lower end of the sleeve is described below as it relates to the lower arm 170. The sleeve 162 can be uncoupled from the rod 162, turned 180°, and re-installed to expose another side facing a customer. This permits each fixture 122 to be reversed such that the sleeve 164 and subframe 158 can pivot towards either the right or the left of the customer. In other embodiments, instead of the sleeve 164, the subframe 158 may be rotatably coupled to a portion of the main frame 154 by any of various types of rotating joints, such as, for example, a pin joint or a hinge joint.

Figure 13:
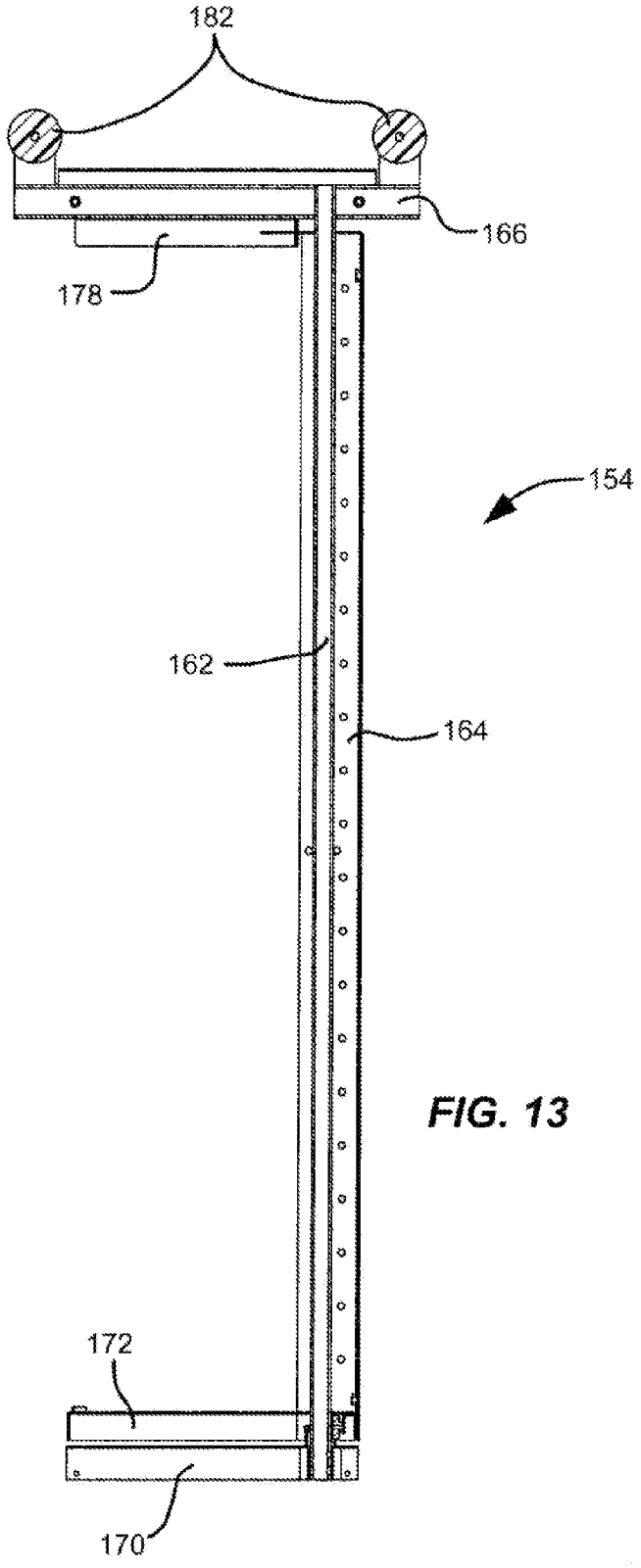
FIG. 13 is an end view of one of the fixtures and tracks of FIG. 11.
Figure 14:
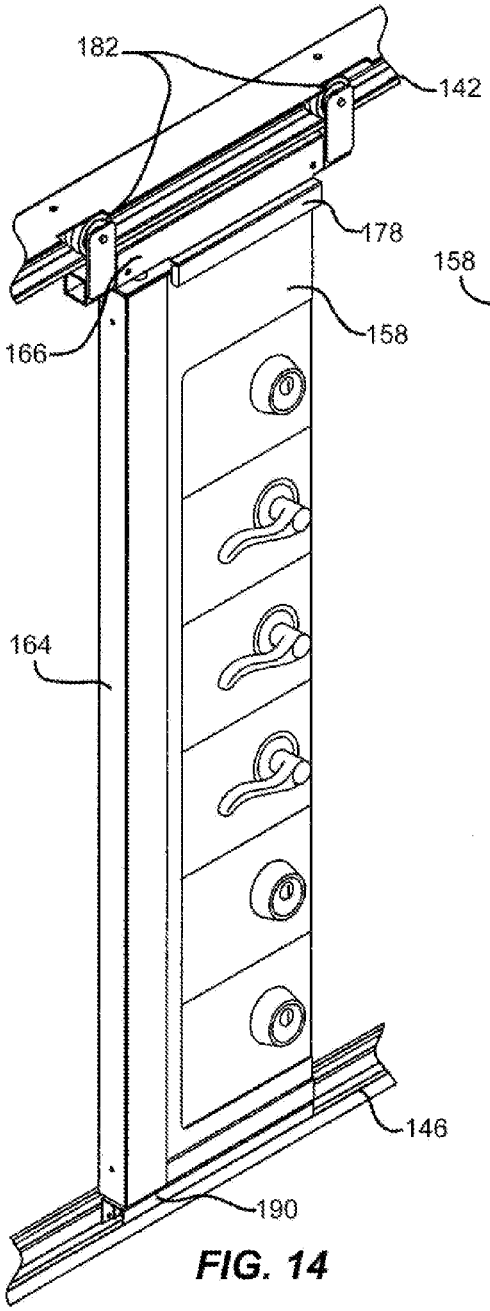
FIG. 14 is a perspective view of the fixture of FIG. 12 in a closed state.
Figure 15:
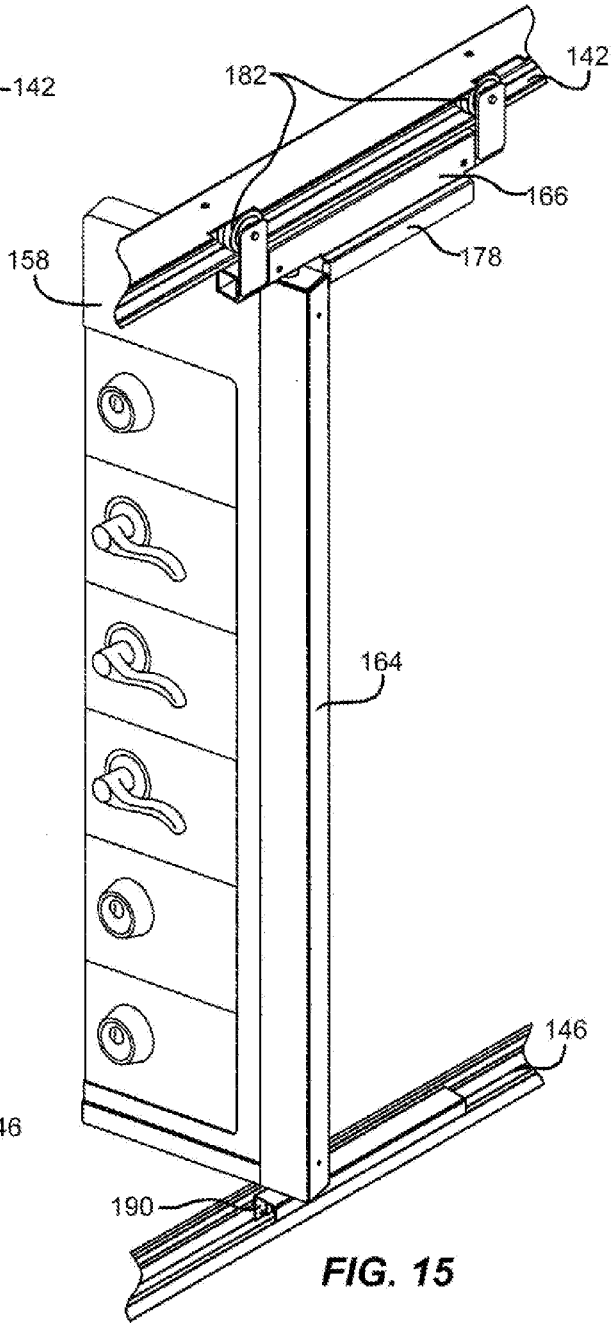
FIG. 15 is a perspective view of the fixture of FIG. 12 in an open state

With reference to FIGS. 13-15, the upper arm 166 includes a stop 178 and rollers 182 that engage the upper portion 142 of the track 114. The stop 178 engages a rear surface of the sleeve 164 and subframe 158 in a closed state (FIG. 14), and the end of the stop 178 engages a back surface of the sleeve 164 when the fixture is "opened" (FIG. 15) to prevent excessive rotation in either a clockwise or a counterclockwise direction. In other embodiments, the sleeve 164 and subframe 158 may extend through a smaller angle or a larger angle. The rollers 182 movably support the fixture 122 in the upper track portion 142 (FIGS. 14 and 15). In other embodiments, the arm 166 may include a sliding element so that the fixture 122 slidingly engages the track 114.

Figure 16:
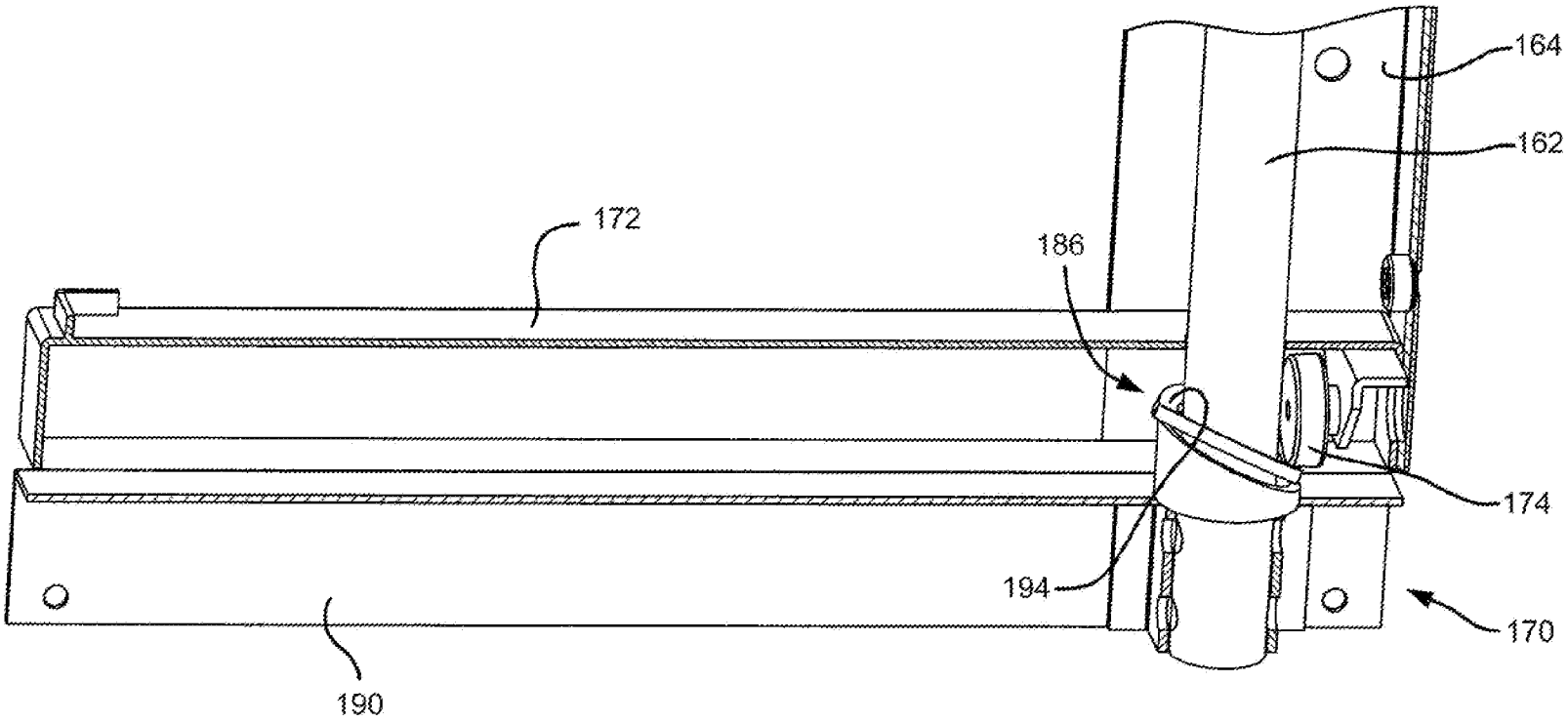
FIG. 16 is an enlarged cross-section view of the main frame of FIG. 13.
Figure 17:
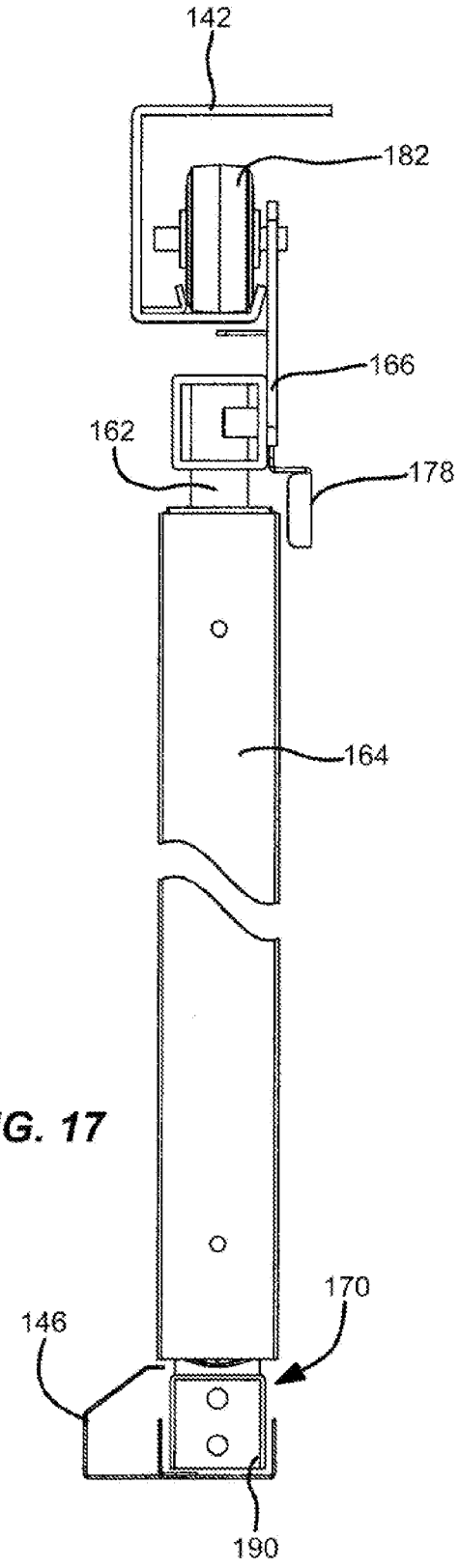
FIG. 17 is a side cross-section view of a track and fixture.

With reference to FIG. 16, the lower arm 170 includes a cam 186 and a guide 190 that engages the lower portion 146 of the track 114. The wheel 174 engages the cam 186, such that as the sleeve 164 rotates, the wheel 174 moves along an incline 194 of the cam 186. This incline 194 biases the sleeve 164 against a rotated position so that when the subframe 158 is released, the sleeve 164 and subframe 158 return to a non-rotated position. As shown in FIG. 17, the guide 190 fits within the second portion 146 of the track 114 to align the fixture 122 as it moves. In other embodiments, rollers may be coupled to the lower arm 170 and would engage the lower portion 146 of the track 114.

Referring again to FIG. 12, the subframe 158 includes a bracket 202 and multiple display pods, or modules 206. The bracket 202 is coupled to the sleeve 162 and is adapted for receiving the modules 206, such as by, for example, fasteners extending through the bracket 202 and each module 206. The bracket 202 includes a top portion 222 that can be covered with branding graphics or other images. In other embodiments, the top portion 222 is not present, providing additional space for receiving modules 206.

Figure 18:
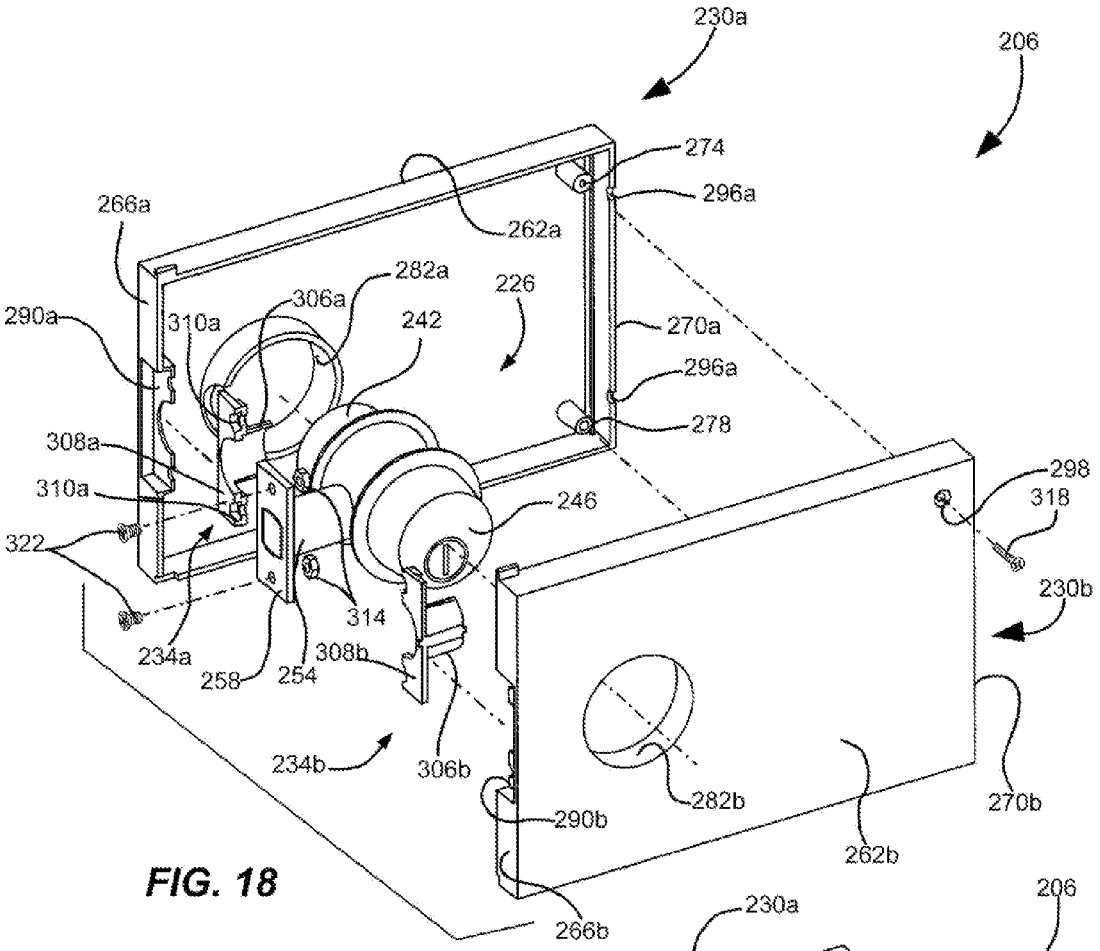
FIG. 18 is an exploded view of a display module.
Figure 19:
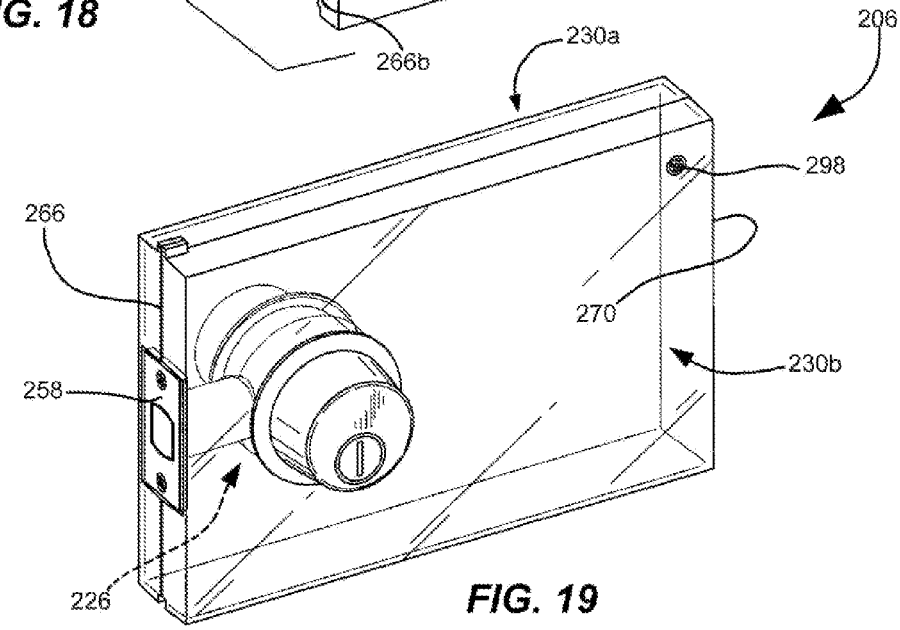
FIG. 19 is a perspective view of an assembled display module.

As illustrated in FIGS. 18 and 19, each module 206 includes a door lock 226, a first side 230*a*, a second side 230*b*, a first insert 234*a*, a second insert 234*b*, and a locking plate 238 (FIG. 12). The illustrated door lock 226 is a deadbolt and includes an interior assembly 242, an exterior assembly 246, and a deadbolt assembly 254 including a face plate 258. A spindle (not shown) extends through the module 206 and couples the interior and exterior assemblies to the deadbolt assembly. The face plate 258 is seated in a recess 290 in an edge surface 266 of the module 206. When assembled with a door lock, the first and second sides of each module display an interior and exterior portion of the door lock, respectively. It shall be appreciated that the terms interior and exterior apply to both door locks which face the interior and exterior of a building or structure as well as those which face the interior and exterior of rooms within a building or structure.

With reference to FIGS. 18 and 19, the first side 230*a* and the second side 230*b* are formed as mating halves that are essentially mirror images of each other with minor differences. The two sides 230*a*, 230*b* are made from a clear composite material, such as polycarbonate. The sides 230*a*, 230*b* are preferably injection molded. The first side 230*a* includes an outer face 262*a*, an outer edge 266*a*, an inner edge 270*a*, a threaded socket 274, and a press fit socket 278. A cylindrical wall 282*a* extends inward from an opening in the outer face 262*a*. The outer edge 266*a* includes a recess 290*a*. The inner edge 270*a* includes a pair of partial holes 296*a*.

The second side 230*b* includes features that are similar to the first side 230*a*, and similar features are denoted by the same reference numbers. The second side includes an outer face 262*b*, an outer edge 266*b*, an inner edge 270*b*, a hole 298, and a pin (not shown). A cylindrical wall 282*b* extends inward from an opening in the outer face 262*b*. The outer edge 266*b* includes a recess 290*b*. The inner edge 270*b* includes a pair of partial holes.

The inserts 234*a* and 234*b* are preferably mirror images of each other, and like elements are denoted with the same reference numerals. The inserts 234*a*, 234*b* are preferably made from a clear composite material, such as polycarbonate and are preferably injection molded. The first insert 234*a* includes a partial tube 306*a*, a flange portion 308*a* and a pair of partial receptacles 310*a*. The tube 306*a* is adapted to receive a portion of the deadbolt assembly 254. The partial receptacles 310*a* each secure a portion of a nut 314. The second insert 234*b* includes features that are similar to the first insert 234*a*. In the illustrated embodiment, when the partial receptacles 310 of the two inserts are aligned, they form complete hexagonal receptacles adapted to receive respective nuts 314.

To assemble the module 206, the flange portion 308*a* of the first insert 234*a* is placed in the recess 290*a* such that the tube 306*a* extends between the recess 290*a* and the cylindrical wall 282*a*. The end of the tube 306*a* aligns with a semicircular recess (not numbered) in the wall 282*a*. One of the nuts 314 is positioned in each receptacle 310*a*. Similarly, the flange portion 308*b* of the second insert 234*b* is placed in the recess 290*b* such that the tube 306*b* extends between the recess 290*b* and the cylindrical wall 282*b*. The end of the tube 306*b* aligns with a semicircular recess (not numbered) in the wall 282*b*. The first side 230*a* and the second side 230*b* are aligned such that the cylindrical walls 282*a*, 282*b* are coaxial and the recesses 290*a*, 290*b* are adjacent. The first side 230*a* and the second side 230*b* are pressed together such that the pin is pressed into the press fit socket 278 and the walls 282*a* and 282*b* meet end-to-end. In addition, when the inserts 234*a*, 234*b* are brought together, the nuts 314 are captured within the receptacles 310. A fastener 318 is then passed through the hole 298 and threaded into the socket 274 to fix the two halves or sides 230*a* and 230*b* together with the inserts 234*a* and 234*b* held in place. Other types of connections may be used to secure the sides 230*a*, 230*b* together, such as multiple press fit pin connections or threaded connections.

The assembled module 206 includes a cylindrical bore that extends between the outer faces 262*a*, 262*b* and is defined by the cylindrical walls 282*a*, 282*b*. In addition, the module 206 includes a bore that is defined by the tubes 306*a*, 306*b* and that extends from the outer edge surface 266 and intersects the cylindrical bore defined by the walls 282*a*, 282*b*. The module 206 thus simulates a portion of a door on which a door lock is mounted and a lock installed in module 206 can be actuated by a customer to simulate its function and performance in an installed state.

The lock 226 is installed in the assembled module 206 in a similar manner as it would be installed in a door. The deadbolt assembly 254 is inserted into the bore defined by the tubes 306*a*, 306*b*, and the face plate 258 is placed over the flange portions 308*a*, 308*b* in the recesses 290*a*, 290*b*. Bolts 322 are inserted through the openings in the face plate 258 and are threaded into the nuts 314 in the same manner screws would normally be threaded into a door. In other embodiments, the inserts 234*a*, 234*b* may form threaded holes that receive screws. In further embodiments, the inserts 234*a*, 234*b* may be formed integrally with the sides 230*a*, 230*b*, respectively. The interior assembly 242 of the lock 226 is inserted in the opening in the face 262*a*, and the exterior assembly 246 is inserted in the opening in the face 262*b*. The assemblies 242, 246 are connected to each other and to the deadbolt assembly 254 in a similar manner as when installed in a door. The connected assemblies 242, 246 help hold the two sides 230*a*, 230*b* together.

The locking plate 238 is secured to the inner edge surface 270 by passing threaded fasteners through the locking plate 238 (FIG. 12) and through the holes 296 on the inner edge surface 270. The locking plate 238 is then coupled to the bracket 202 in any of various methods including passing threaded fasteners through the bracket 202 and locking plate 238 and securing the fasteners with a nut.

The assembled thickness of the module 206 is similar to that of a standard door. The modules 206 can be switched out and replaced by uncoupling the module 206 from the bracket 202 and substituting a different module 206. In the illustrated embodiments, the modules 206 have heights of 4 inches, 6 inches, 8 inches, or 20 inches. The different sizes allow the seller to mount lock assemblies 226 of various dimensions. In other embodiments, the subframe 158 may include only one module 206 that is coupled to the bracket 202, and each module 206 supports multiple lock assemblies 226. Different modules will have different numbers of openings as is necessary to mount different types of door locks.

The fixtures 122 are configured to be moved as desired by a customer, so that the customer may simultaneously compare various locks side-by-side as well as at various lateral and rotational configurations relative to one another. For instance, a door knob on one module 206 of one fixture 122 may be moved horizontally and positioned adjacent another knob on another fixture 122 either on the same track or on offset tracks. The customer may also rotate the fixtures 122 to simultaneously display the opposite sides of their respective door locks side-by-side or in other configurations. The customer may operate the door knob and rotate the subframe 158 about the rod 162, simulating the operation of a door. Also, because the modules 206 are composed of a clear material, the customer can examine the interior working components of the lock assembly 226, especially during operation. The interactive merchandise display portion 70 provides an efficient and helpful interface for the customer to compare various locks.

As locks are updated, the modules 206 may be replaced to change out older door locks with newer door locks. Because the modules 206 may be switched out and replaced easily, the door locks may be updated quickly and frequently. Also, the composite material of the modules 206 reduces costs related to shipping, installation, and fabrication. In addition, the adjustable shelf portions 62, 66 accommodate changes in product packaging, allowing the seller to expand the width of the shelf 86 and adjust the spacing of the door locks. Furthermore, the reversible nature of the fixtures 122 provides multiple configurations for the fixtures 122, depending on the positioning of the merchandizing platform 10 within a store, customer traffic patterns, and the preference for simulating a door that opens to the left or the right of a customer.

Figure 20:
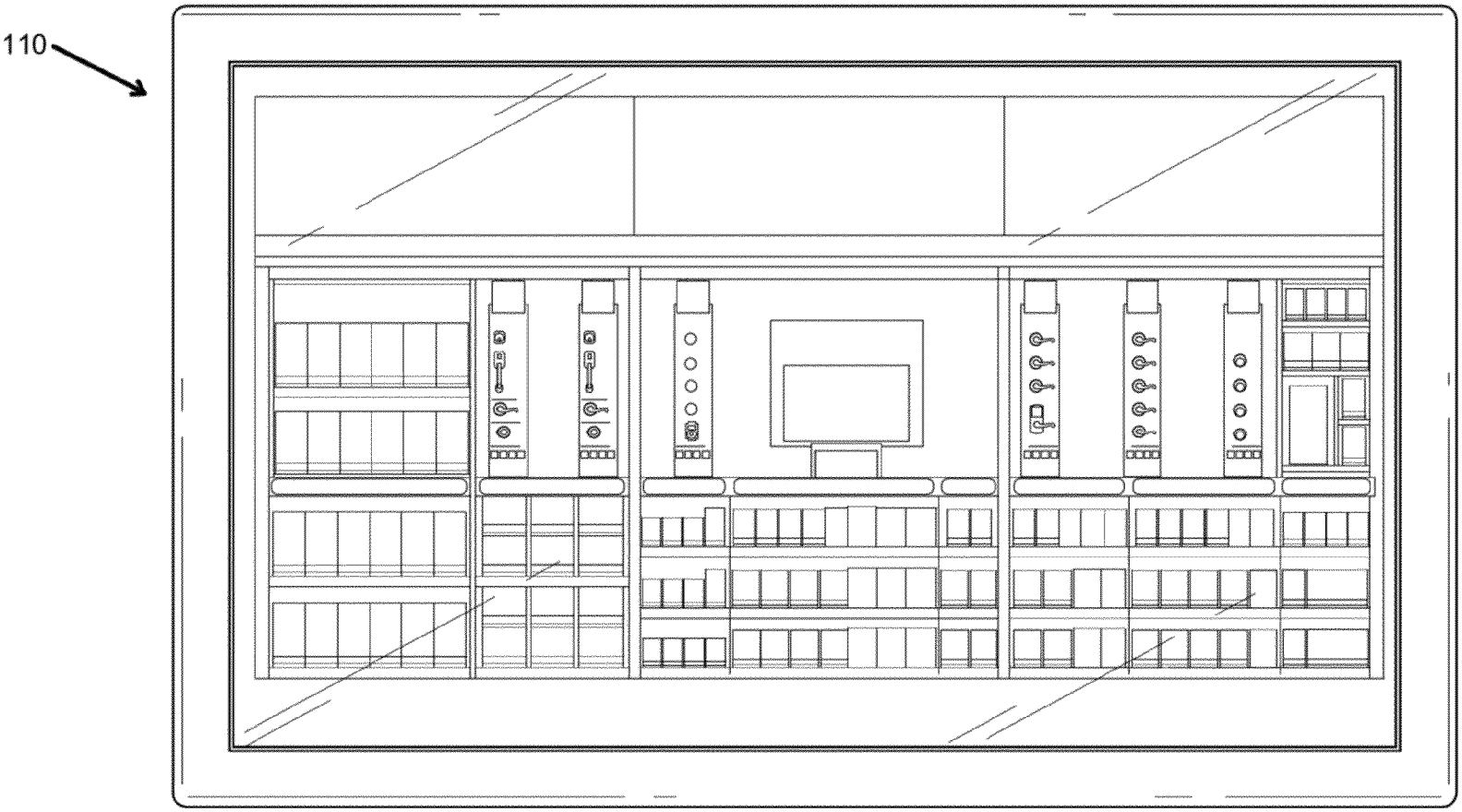
FIG. 20 illustrates a display of a customer interaction unit.

With reference to FIG. 20, there is illustrated a display of a customer interaction unit 110. In the illustrated form, the customer interaction unit 110 shows the image of the merchandizing platform 10 and indicates the position of the door lock on the inventory shelves 46 and/or the adjustable shelf portions 62, 66. The display may also show other graphical representations of the configuration of the retail merchandizing platform 10, such as simplified diagrams. The customer interaction unit is also configured to store the inventory and display locations of the different locks in inventory and on display. This information may be updated as locks in inventory and on display change. When customer input indicating a particular type of lock is received, the location in the inventory storage region containing the particular lock may be highlighted, for example, such as by highlighting the position on the screen, inserting an arrow or other marker pointing to the location, enlarging the location, and/or graying out the other sections of the shelf where the lock is not located, as well as changing contrast or brightness, adding color, flashing or providing other visual indicia emphasizing the location. A portion of the wayfinding bar 30 corresponding to the location may also be highlighted. Thus, the customer interaction unit 110 and wayfinding bar 30 may be used to aid the customer in selecting a lock and locating the position of a lock on a shelf. A number of additional techniques can be utilized to aid customers in locating locks of interest, for example, providing alphanumeric visual or audio output indicating the location or other techniques which convey location information.

Customer input indicating a particular lock may be received in a number of manners. In one form the customer interaction unit 110 is configured with executable code stored in memory medium which is executable to guide the customer in selecting a lock. Upon approaching the customer interaction unit 110, the customer is prompted to answer various questions related to the lock application. These questions may include describing the location where the lock will be used, the type and color of the door, the type, style and finish of the lock, and other features of the door or lock. The customer interaction unit 110 then displays a recommendation for a particular door lock based on the information gathered from the customer. The customer interaction unit 110 may also highlight a location on a fixture 122 which includes a display model of the lock of interest. Additionally, if a lock is out of stock, the program allows the customer to order the lock, or the program may recommend the next-most appropriate lock based on the customer's input.

The customer interaction unit 110 can also assist the customer in locating particular locks in inventory. As described above customer input indicating a lock of interest may be provided through customer input to the touch screen of the customer interaction unit 110 or through a number of additional customer input devices associated with display locks. The position may be indicated in various ways as described above. The wayfinding bar 30 orients the customer with respect to the organization of the door locks. These features allow a customer to easily locate the door lock.

The aspects summarized above and the exemplary embodiments illustrated and described in detail in the figures and foregoing description are illustrative and not limiting or restrictive. It shall be understood that various features and aspects of the embodiments described above may not be necessary and embodiments lacking the same are also protected and that all changes and modifications that come within the scope of the invention are to be protected. It shall be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

The invention claimed is:

1. A door lock merchandising display apparatus comprising:

a support structure including a merchandise display region;

a first fixture coupled with the support structure and positioned in the merchandise display region, the first fixture being laterally and rotatably moveable relative to the support structure;

a first merchandise module including a first cylindrical bore and a first door lock mounted in the first cylindrical bore, the first merchandise module being detachably coupled with the first fixture, an interior portion of the first door lock being displayed from a first side of the first merchandise module and an exterior portion of the first door lock being displayed from a second side of the first merchandise module;

a second fixture coupled with the support structure and positioned in the merchandise display region, the second fixture being laterally and rotatably moveable relative to the support structure; and a second merchandise module including a second cylindrical bore and a second door lock mounted in the second cylindrical bore, the second merchandise module being detachably coupled with the second fixture, an interior portion of the second door lock being displayed from a first side of the second merchandise module and an exterior portion of the second door lock being displayed from a second side of the second merchandise module;

wherein the first fixture and the second fixture are positionable by a customer to selectably simultaneously display to the customer the interior portion of the first door lock and the interior portion of the second door lock and to selectably simultaneously display to the customer the exterior portion of the first door lock and the exterior portion of the second door lock.

2. A door lock merchandising display apparatus according to claim 1 wherein the first fixture is coupled with a track, the track is coupled with and extends laterally along at least a portion of the support structure, and the first fixture is laterally moveable along the track and rotatable relative to the track.

3. A door lock merchandising display apparatus according to claim 2 wherein the second fixture is coupled with the track, laterally moveable along the track, and rotatable relative to the track.

4. A door lock merchandising display apparatus according to claim 2 wherein the second fixture is coupled with a second track, the second track is coupled with and extends laterally along at least a portion of the support structure and the second fixture is laterally moveable along the second track and rotatable relative to the second track.

5. A door lock merchandising display apparatus according to claim 4 wherein a direction of lateral movement of the first fixture along the first track is offset from a direction of lateral movement of the second fixture along the second track.

6. A door lock merchandising display apparatus according to claim 1 comprising: a plurality of merchandise modules including respective door locks, the plurality of merchandise modules being detachably coupled with the first fixture.

7. A door lock merchandising display apparatus according to claim 1 comprising:

a third fixture coupled with the support structure and positioned in the merchandise display region, the third fixture being laterally and rotatably moveable relative to the support structure; and a third merchandise module including a third door lock, the merchandise module being detachably coupled with the third fixture, an interior portion of the third door lock being displayed from a first side of the third merchandise module and an exterior portion of the third door lock being displayed from a second side of the third merchandise module;

wherein the third fixture is positionable by the customer to selectably simultaneously display to the customer the interior portion of the first door lock and the interior portion of the third door lock, selectably simultaneously display to the customer the exterior portion of the first door lock and the exterior portion of the third door lock, selectably simultaneously display to the customer the interior portion of the first door lock and the interior portion of the second door lock, selectably simultaneously display to the customer the exterior portion of the first door lock and the exterior portion of the second door lock, selectably display to the customer the interior portion of the second door lock and the interior portion of the third door lock, and selectably simultaneously display to the customer the exterior portion of the second door lock and the exterior portion of the third door lock.

8. A door lock merchandising display apparatus according to claim 1 wherein the support structure further comprises a customer-accessible inventory storage region located below the merchandise display region, the customer-accessible inventory storage region containing a plurality of types of door locks including the types of door locks associated with the merchandise modules.

9. A door lock merchandising display apparatus according to claim 1 wherein the first fixture and the second fixture are positionable by a customer to selectably display to the customer the interior portion of the first door lock adjacent the interior portion of the second door lock, and to selectably display to the customer the exterior portion of the first door lock adjacent the exterior portion of the second door lock.

10. A door lock merchandising display apparatus according to claim 1 wherein the first fixture and the second fixture are positionable by a customer to selectably simultaneously display the interior portions of the first door lock and the second door lock next to one another and selectably simultaneously display the exterior portions of the first door lock and the second door lock next to one another.

11. A door lock merchandising display apparatus comprising:

a support structure including a merchandise display region;

a first fixture coupled with the support structure and positioned in the merchandise display region, the first fixture being laterally and rotatably moveable relative to the support structure;

a first merchandise module including a first door lock, the first merchandise module being detachably coupled with the first fixture, an interior portion of the first door lock being displayed from a first side of the first merchandise module and an exterior portion of the first door lock being displayed from a second side of the first merchandise module;

a second fixture coupled with the support structure and positioned in the merchandise display region, the second fixture being laterally and rotatably moveable relative to the support structure; and a second merchandise module including a second door lock, the second merchandise module being detachably coupled with the second fixture, an interior portion of the second door lock being displayed from a first side of the second merchandise module and an exterior portion of the second door lock being displayed from a second side of the second merchandise module;

wherein the first fixture and the second fixture are positionable by a customer to selectably simultaneously display to the customer the interior portion of the first door lock and the interior portion of the second door lock and to selectably simultaneously display to the customer the exterior portion of the first door lock and the exterior portion of the second door lock; and wherein the support structure includes an inventory storage region accessible to the customer and a customer interaction unit, the inventory storage region containing a plurality of types of door locks at a respective plurality of locations, the customer interaction unit configured to receive an input from a customer indicating a particular type of door lock, and provide an output to the customer identifying a location in the inventory storage region containing the particular type of door lock.

12. A door lock merchandising display apparatus according to claim 11 comprising a first input mechanism associated with the first merchandise module and a second input mechanism associated with the second merchandise module, wherein the first input mechanism and the second input mechanism are configured to communicate input from a customer indicating the particular type of door lock to the customer interaction unit.

13. A door lock merchandising display system comprising:

a merchandising platform including a display region, a customer-accessible inventory storage region, and a customer interaction unit;

a plurality of merchandise display fixtures each including one or more door locks positioned in the display region, each of the door locks including an interior portion and an exterior portion, the merchandise display fixtures being moveable by the customer to a first configuration displaying the interior portions of at least two locks next to one another and moveable by the customer to a second configuration displaying the exterior portions of the at least two locks next to one another;

the customer-accessible inventory storage region including a plurality of types of door locks including the types of door locks of the merchandise display fixtures; and the customer interaction unit configured to receive customer input associated with a particular type of door lock of the door locks of the merchandise display fixtures in the display region, and to provide an output to the customer identifying a location of the particular type of door lock in the customer-accessible inventory storage region;

wherein the one or more door locks positioned in the display region comprise display models of the types of door locks in the customer-accessible inventory storage region.

14. A door lock merchandising display system according to claim 13 wherein the merchandise display fixtures are laterally moveable in the display region along one or more tracks.

15. A door lock merchandising display system according to claim 14 wherein the merchandise display fixtures are rotatable in the display region.

16. A door lock merchandising display system according to claim 13 wherein the merchandise display fixtures are each detachably coupled with a respective plurality of display modules each including a door lock.

17. A door lock merchandising display system according to claim 13 comprising at least two merchandise display fixtures laterally moveable within the display region along a track.

18. A door lock merchandising display system according to claim 17 comprising at least one merchandise display fixture laterally moveable within the display region along a second track.

19. A door lock merchandising display system according to claim 13 comprising at least three merchandise display fixtures moveable by the customer to selectably display the interior portions of a first door lock and a second door lock next to one another, selectably display the interior portions of the first door lock and a third door lock next to one another, and selectably display the interior portions of the second door lock and the third door lock next to one another.

20. A door lock merchandising display system according to claim 19 wherein the merchandise display fixtures are moveable by the customer to selectably display the exterior portions of the first door lock and the second door lock next to one another, selectably display the exterior portions of the first door lock and the third door lock next to one another, and selectably display the exterior portions of the second door lock and the third door lock next to one another.

21. A door lock merchandising display system according to claim 13 wherein the customer interaction unit is further configured to prompt the customer to provide information relating to a lock application, and to display information relating to a recommended door lock based on the provided information.

* * * * *